US008294665B1

(12) United States Patent
Power

(10) Patent No.: US 8,294,665 B1
(45) Date of Patent: Oct. 23, 2012

(54) AREA-BASED DATA ENTRY

(75) Inventor: Michael J. Power, Mountain View, CA (US)

(73) Assignee: Intuit Inc., Mountain View, CA (US)

( * ) Notice: Subject to any disclaimer, the term of this patent is extended or adjusted under 35 U.S.C. 154(b) by 1138 days.

(21) Appl. No.: 12/171,687

(22) Filed: Jul. 11, 2008

(51) Int. Cl.
*G09G 5/00* (2006.01)

(52) U.S. Cl. ..... 345/156; 715/863

(58) Field of Classification Search ..... 345/156–184; 715/700–715, 768–773, 778–801, 815, 856–866; 341/22–34; 434/72–80, 107–110; 708/800–854
See application file for complete search history.

(56) References Cited

U.S. PATENT DOCUMENTS 3,652,842 A * 3/1972 Lewin ..... 708/830
3,906,190 A * 9/1975 Light ..... 708/830
5,410,494 A * 4/1995 Hashimoto et al. ..... 345/173
5,818,460 A * 10/1998 Covey et al. ..... 345/443
6,965,454 B1 * 11/2005 Silverbrook et al. ..... 358/1.9
2002/0145616 A1 * 10/2002 Doan ..... 345/629
2003/0025696 A1 * 2/2003 Mulgan ..... 345/440
2003/0195039 A1 * 10/2003 Orr et al. ..... 463/31
2009/0300554 A1 * 12/2009 Kallinen ..... 715/863

* cited by examiner

*Primary Examiner* — Liliana Cerullo

(74) *Attorney, Agent, or Firm* — Park, Vaughan, Fleming & Dowler LLP; Chia-Hsin Suen

(57) ABSTRACT

Some embodiments of the present invention provide a system that receives input from a user of a computing device. During operation, the system displays an input region to the user and receives a specification for a subregion of the input region from the user. Next, the system determines an area of the subregion. Finally, the system provides the input to the computing device based on the area of the subregion relative to the area of the input region.

27 Claims, 11 Drawing Sheets

AREA-BASED DATA ENTRY

BACKGROUND

Related Art

Embodiments of the present invention provide techniques for area-based data entry.

A user typically interacts with a computing device, such as a personal computer (PC), mobile phone, personal digital assistant (PDA), and/or calculator, by providing input to and receiving output from the computing device through various input and output mechanisms. For example, the user may enter input into a PC using a keyboard or mouse and receive output from the PC via a display screen and/or speakers.

Furthermore, one or more user interfaces (UIs) in the computing device may provide mechanisms that facilitate interactions between the user and computing device. For example, a UI in a computer system may provide UI components such as a cursor, windows, menus, icons, checkboxes, text boxes, and/or radio buttons. These UI components are typically displayed to the user through a display screen connected to the computer system. This enables the user to manipulate the UI components by moving the cursor; clicking, dragging, and/or selecting areas of the UI with the cursor; and entering text and/or keyboard shortcuts into the UI.

Usability is an important consideration in designing user interfaces. In particular, usability considerations may include the efficiency with which tasks are accomplished through the user interface, the user's ability to learn and master the operation of the user interface, and/or the user's satisfaction in interacting with the user interface. For example, the user may find certain input methods, such as pointing to a region within a touchscreen, to be more satisfying and/or easier than other input methods, such as typing a combination of letters, numbers, and special characters into multiple form fields. Similarly, the arrangement of user interface elements may affect the user's ability to navigate the user interface. Consequently, user satisfaction with a computing device may be highly influenced by characteristics of the user interface provided by the computing device.

SUMMARY

Some embodiments of the present invention provide a system that receives input from a user of a computing device. During operation, the system displays an input region to the user and receives a specification for a subregion of the input region from the user. Next, the system determines an area of the subregion. Finally, the system provides the input to the computing device based on the area of the subregion relative to the area of the input region.

In some embodiments, receiving the specification for the subregion involves receiving a cursor sweep within the input region from the user, wherein the subregion is the portion of the input region below the cursor sweep.

In some embodiments, the system also receives a modification to the subregion from the user and updates the area of the subregion based on the modification.

In some embodiments, receiving the modification involves receiving an additional cursor sweep within the input region.

In some embodiments, the modification corresponds to at least one of an addition to the subregion, a subtraction from the subregion, a change in size of the input region, and a change in scale of the input region.

In some embodiments, the addition to the subregion corresponds to addition of an area between the border of the subregion and the additional cursor sweep, and the subtraction from the subregion corresponds to subtraction of an area between the border of the subregion and the additional cursor sweep.

In some embodiments, the addition or subtraction is made based on a path of the additional cursor sweep.

In some embodiments, the change in size of the input region is caused by an ending point of the additional cursor sweep past the top of the input region.

In some embodiments, the change in scale of the input region is caused by starting and ending the additional cursor sweep at the same point in the input region.

In some embodiments, the cursor sweep is performed by the user manipulating a pointing device associated with the computing device.

In some embodiments, the pointing device can include a mouse, a touch pad, a finger or a stylus on a touch-sensitive display, a trackball, a pointing stick, and a joy stick.

In some embodiments, the input is numeric input. In these embodiments, the numeric input is calculated from the area of the subregion relative to the area of the input region as a fraction of a number associated with the input region.

In some embodiments, the subregion is displayed as a filled-in portion of the input region.

DETAILED DESCRIPTION

Figure 1:
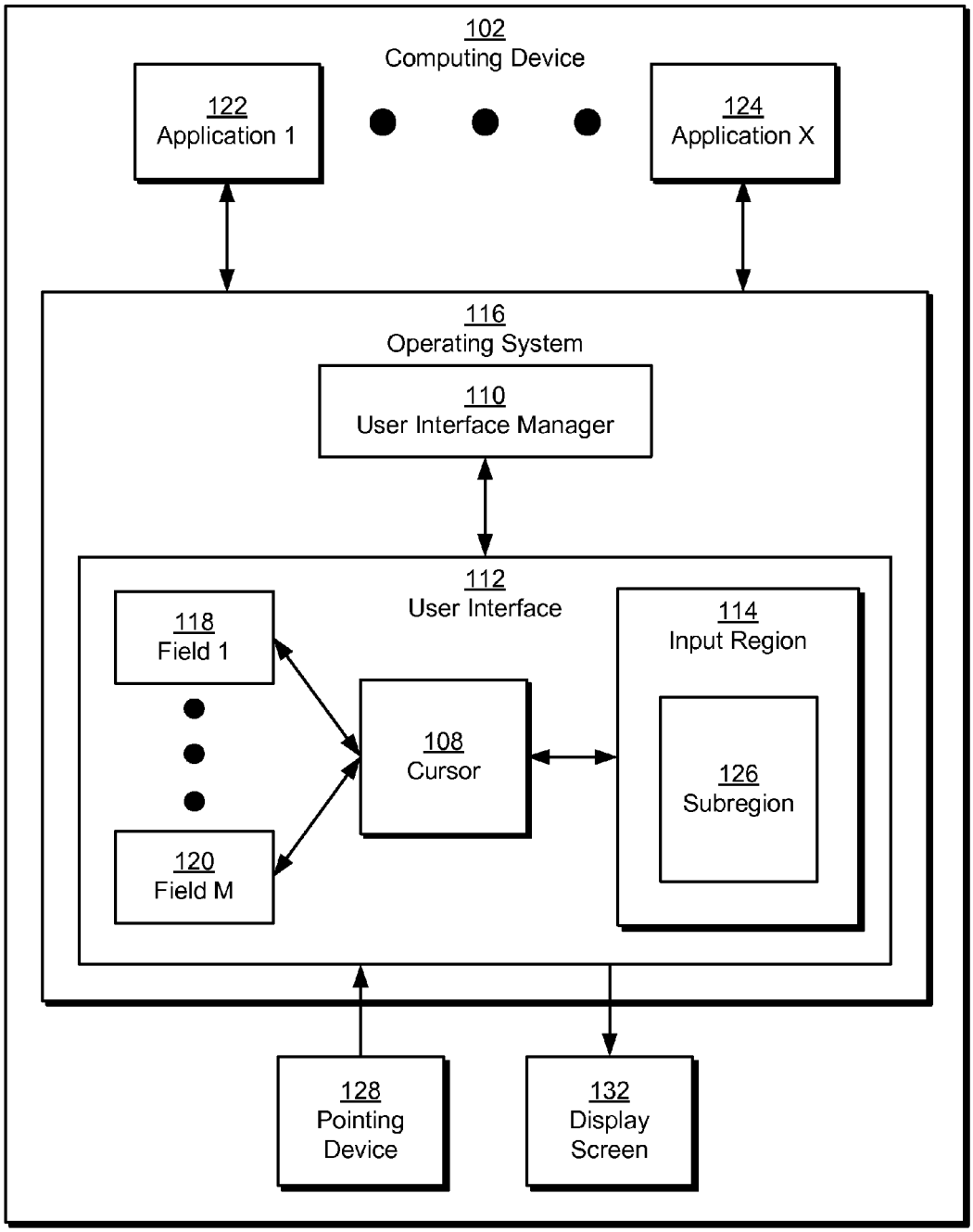
FIG. 1 shows a schematic of a system in accordance with an embodiment of the present invention.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

The data structures and code described in this detailed description are typically stored on a computer-readable storage medium, which may be any device or medium that can store code and/or data for use by a computer system. The computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing computer-readable media now known or later developed.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium.

Furthermore, the methods and processes described below can be included in hardware modules. For example, the hardware modules can include, but are not limited to, application-specific integrated circuit (ASIC) chips, field-programmable gate arrays (FPGAs), and other programmable-logic devices now known or later developed. When the hardware modules are activated, the hardware modules perform the methods and processes included within the hardware modules.

Embodiments of the invention provide a method and system for receiving input from a user of a computing device. The computing device may be, for example, a personal computer (PC), a mobile phone, a personal digital assistant (PDA), a graphing calculator, a portable media player, and/or a global positioning system (GPS) receiver.

More specifically, embodiments of the invention provide a method and system for area-based data entry into the computing device. Input to the computing device is based on a specified subregion of an input region provided by the user. The subregion may be specified by sweeping a cursor within the input region, wherein the subregion is the portion of the input region below the cursor sweep. In addition, modifications to the subregion may be made by the user through additional cursor sweeps within the input region. The modifications may include additions to the subregion, subtractions from the subregion, changes in size to the input region, and changes in scale to the input region.

In one or more embodiments of the invention, the input corresponds to numeric input. Furthermore, the numeric input is calculated as a fraction of a number that is based on the ratio between the area of the subregion and the area of the input region. The numeric input may also be updated by adding to and subtracting from the subregion using additional cursor sweeps. Embodiments of the invention thus provide an alternative means for providing user input to a computing device.

FIG. 1 shows a computing device 102 in accordance with an embodiment of the present invention. As shown in FIG. 1, computing device 102 includes multiple applications (e.g., application 1 122, application x 124), an operating system 116, a pointing device 128, and a display screen 132. Each of these components is described in further detail below.

Computing device 102 may correspond to an electronic device that provides one or more services or functions to a user. For example, computing device 102 may operate as a mobile phone, personal computer (PC), global positioning system (GPS) receiver, portable media player, personal digital assistant (PDA), and/or graphing calculator. In addition, computing device 102 may include an operating system 116 that coordinates the use of hardware and software resources on computing device 102, as well as one or more applications (e.g., application 1 122, application x 124) that perform specialized tasks for the user. For example, computing device 102 may include applications (e.g., application 1 122, application x 124) such as an email client, an address book, a document editor, a tax preparation application, a web browser, and/or a media player. To perform tasks for the user, applications (e.g., application 1 122, application x 124) may obtain the use of hardware resources (e.g., processor, memory, I/O components, wireless transmitter, etc.) on computing device 102 from operating system 116, as well as interact with the user through a hardware and/or software framework provided by operating system 116, as described below.

To enable interaction with the user, computing device 102 may include one or more hardware input/output (I/O) components, such as pointing device 128 and display screen 132. Each hardware I/O component may additionally be associated with a software driver (not shown) that allows operating system 116 and/or applications on computing device 102 to access and use the hardware I/O components.

Display screen 132 may be used to display images and/or text to one or more users of computing device 102. In one or more embodiments of the invention, display screen 132 serves as the primary hardware output component for computing device 102. For example, display screen 132 may allow the user(s) to view menus, icons, windows, emails, websites, videos, pictures, maps, documents, and/or other components of a user interface 112 provided by operating system 116. Those skilled in the art will appreciate that display screen 132 may incorporate various types of display technology to render and display images. For example, display screen 132 may be a liquid crystal display (LCD), an organic light-emitting diode (OLED) display, a surface-conducting electron-emitter display (SED), and/or other type of electronic display.

Pointing device 128 may function as a hardware input component of computing device 102. Specifically, pointing device 128 may allow the user to point to and/or select one or more areas of display screen 132 using a cursor 108, highlight, and/or other visual indicator provided by user interface 112. Input entered by the user using pointing device 128 may be processed by the corresponding software driver and sent to operating system 116 and/or one or more applications (e.g., application 1 122, application x 124) as one or more actions. In one or more embodiments of the invention, pointing device 128 may be a mouse, a touch pad, a finger or a stylus on a touch-sensitive display, a trackball, a pointing stick, and/or a joystick.

Those skilled in the art will appreciate that other input devices (not shown) may exist on computing device 102. For example, computing device 102 may also include a keyboard, webcam, remote control, and/or one or more sets of device-specific buttons. Operating system 116 and/or the application (s) (e.g., application 1 122, application x 124) may use the input from the input device(s) to perform one or more tasks, as well as update user interface 112 through a user interface manager 110 in response to the input. Images corresponding to user interface 112 may be sent by operating system 116 to a screen driver, which may display the images on display screen 132 as a series of pixels. As a result, the user may interact with computing device 102 by using pointing device 128 and/or other input devices to provide input to operating system 116 and/or applications and receiving output from operating system 116 and/or applications through display screen 132.

In one or more embodiments of the invention, the user enters input into computing device 102 by interacting with an input region 114 in user interface 112. In one or more embodiments of the invention, input region 114 is viewed on display screen 132 along with cursor 108. To enter input into computing device 102, the user may specify a subregion 126 within input region 114 by sweeping cursor 108 within input region 114. The input is then based on the area of subregion 126 relative to the area of input region 114. In other words, the input may be based on a fraction or ratio of the size of subregion 126 relative to the size of input region 114.

In particular, the user may sweep cursor 108 within a rectangular input region 114 to specify subregion 126 within the rectangular input region. For example, the user may click on a mouse or touchpad while tracing a path through a part of input region 114 with the mouse or touchpad. Alternatively, the user may sweep cursor 108 through input region 114 using a stylus; the level of pressure applied using the stylus and/or additional input by the user may determine the portion of cursor 108 movement within input region 114 that corresponds to a cursor 108 sweep. Those skilled in the art will appreciate that input region 114 may correspond to a variety of shapes, including circles, ellipses, polygons, and/or irregularly shaped areas of user interface 112.

In one or more embodiments of the invention, subregion 126 is received as a portion of input region 114 below the cursor sweep. In other words, subregion 126 may correspond to an "area under the curve" created by the cursor sweep. Alternatively, subregion 126 may be created by enclosing a portion of input region 114 using cursor 108, dragging a variety of stencils onto input region 114, and/or other cursor-based methods specified by user interface manager 110. Once created, subregion 126 may be displayed as a filled-in portion of input region 114. For example, subregion 126 may be shaded, colored, and/or otherwise filled to indicate the portion of input region 114 corresponding to subregion 126.

Furthermore, modifications to subregion 126 may be made by additional cursor 108 sweeps within input region 114 by the user. The modifications may correspond to additions to subregion 126, subtractions from subregion 126, changes in size of input region 114, and/or changes in scale of input region 114. In addition, each modification to subregion 126 may be based on a path of the cursor 108 sweep corresponding to the modification, as described below.

In particular, an addition to subregion 126 may be made if the path of an additional cursor 108 sweep starts outside subregion 126 and remains outside subregion 126. Cursor 108 may be outside subregion 126 if cursor 108 is located outside subregion 126 within input region 114 or outside input region 114 altogether. For example, the additional cursor 108 sweep may outline a circle or other enclosed shape above subregion 126 within input region 114. Alternatively, the additional cursor 108 sweep may trace a line above subregion 126 within input region 114; as with the first cursor 108 sweep defining subregion 126, the portion of input region 114 below the traced line may be added to subregion 126. If a portion of subregion 126 exists below the traced line, then the area between the border of subregion 126 and the traced line made by the additional cursor 108 sweep is added to subregion 126.

An addition to subregion 126 may also be made if the additional sweep of cursor 108 begins within subregion 126 and traces a line outside subregion 126 within input region 114. For example, an additional cursor 108 sweep that outlines an enclosed shape may add to subregion 126 if the cursor 108 sweep begins and ends inside subregion 126 with a portion of the cursor 108 sweep tracing an arc outside subregion 126. The area between the arc and subregion 126 may then be added to subregion 126. Similarly, an additional cursor 108 sweep that begins within subregion 126 and draws a line to the outside of subregion 126 within input region 114 may constitute an addition of the area between the line and above subregion 126 to subregion 126. Additions to subregion 126 are discussed in further detail below with respect to FIGS. 2B, 3, 5A, and 5B.

On the other hand, a subtraction to subregion 126 may be made if the path of an additional cursor 108 sweep starts within subregion 126 and remains within subregion 126. For example, the additional cursor 108 sweep may outline an enclosed shape within subregion 126. The additional cursor 108 sweep may also trace a line within subregion 126; the portion of input region 114 below the line may then be subtracted from subregion 126. A subtraction may also occur if cursor 108 begins within subregion 126 and remains within subregion 126 until cursor 108 exits input region 114.

Similarly, a subtraction to subregion 126 may be made if the additional cursor 108 sweep starts outside subregion 126 and traces a line within subregion 126. For example, an enclosed shape that begins and ends outside subregion 126 with a portion of the enclosed shape within subregion 126 may subtract that portion of the enclosed shape from subregion 126. An additional cursor 108 sweep that begins outside subregion 126 and draws a line to the inside of subregion 126 may cause the portion of subregion 126 between the line and the upper border of subregion 126 to be subtracted. As a result, additional cursor sweeps that cause subtractions to subregion 126 may correspond to inverses of additional cursor sweeps that cause additions to subregion 126. Subtractions to subregion 126 are discussed in further detail below with respect to FIGS. 2C, 2D, 4A, and 4B.

A change in the size of input region 114 may be made if the additional cursor 108 sweep ends past the top of input region 114. For example, input region 114 may be doubled, quadrupled, and/or otherwise increased. Similarly, subregion 126 may be reduced in size relative to the size of input region 114 to indicate that a smaller portion of input region 114 is taken up by subregion 126. Changes in size to input region 114 are discussed below with respect to FIGS. 5A-5B.

A change in the scale of input region 114 may be made if an enclosed shape is traced using the additional cursor 108 sweep. An additional window, subwindow, and/or other user interface 112 element may be shown to the user containing a zoomed-in version of the enclosed shape, as well as a portion of input region 114 surrounding the enclosed shape. The user may then use the zoomed-in view to refine the addition or subtraction to subregion 126 made by the enclosed shape. Changes in scale to input region 114 are discussed below with respect to FIGS. 4A-4B.

Those skilled in the art will appreciate that rules governing the behavior of cursor sweeps within input region 114 may be further specified, refined, and/or altered. For example, cursor 108 sweeps that move in and out of subregion 126 multiple times may be interpreted in a variety of ways by user interface manager 110. In particular, user interface manager 110 may only subtract or only add from subregion 126 based on the starting and ending points of the cursor 108 sweeps. Alternatively, user interface manager 110 may both add and subtract from subregion 126 based on the portions of the cursor 108 sweeps that lie inside and outside of subregion 126. As with the initial creation of subregion 126, subsequent modifications to subregion 126 may also be based on actions outside of cursor 108 sweeps by the user, such as the use of stencils and shapes.

Along the same lines, additions and subtractions to subregion 126 may be made using other input methods. For example, the user may modify subregion 126 by sweeping cursor 108 within input region 114 and holding down an extra button, key, and/or other input device that specifies the action (i.e., addition or subtraction) to be taken using the cursor 108 sweep. Changes in size and scale to input region 114 may also be specified using various combinations of user input. For example, the user may zoom in and out of input region 114 and/or expand and crop input region 114 through a combination of keyboard shortcuts and/or button presses.

As shown in FIG. 1, user interface 112 also includes a set of fields (e.g., field 1 118, field m 120). In one or more embodiments of the invention, input by the user into input region 114 is entered directly into one or more fields. For example, the fields may correspond to form fields within user interface 112 for obtaining information from the user. Each field may further be configured to receive a specific type of input from the user, such as a date, a name, an address, a dollar amount, and/or a phone number. Each field may be associated with a separate input region, or input region 114 may be used to provide input to multiple fields by residing in a separate window, frame, and/or other section of user interface 112.

In one or more embodiments of the invention, user input provided to input region 114 corresponds to numeric input. As described above, input to computing device 102 may be based on the area of subregion 126 relative to the area of input region 114. Furthermore, the numeric input may be calculated from the relative areas of subregion 126 and input region 114 as a fraction of a number associated with input region 114, such as a number corresponding to the size of input region 114. For example, if input region 114 corresponds to the number 100 and the area of subregion 126 is 55% of the area of input region 114, the numeric input may be calculated as 55% of 100, or 55. Similarly, if input region 114 corresponds to the number 24 and the area of subregion 126 is 75% of the area of input region 114, the numeric input may be calculated as 75% of 24, or 18.

Non-numeric input may also be entered using input region 114 and cursor 108. In particular, numeric input obtained using input region 114 and subregion 126 may be mapped to non-numeric input. For example, an input region 114 corresponding to the number 26 may be mapped to the letters of the alphabet. The number obtained from the relative areas of subregion 126 and input region 114 may be mapped to an alphabetic letter by rounding to the nearest whole number (e.g., "5") and using the alphabetic letter corresponding to the whole number (e.g., "E") as input. The user may select from other sorted lists of possible input (e.g., countries, books, words, etc.) in the same fashion.

Once the input is entered into the corresponding field and reviewed by the user, the input may be submitted by the user to computing device 102 for use by operating system 116 and/or one or more applications to perform tasks for the user. For example, personal and financial information provided by the user through cursor 108, input region 114, and/or the form fields of user interface 112 may be used by a tax preparation application to prepare and file tax forms on the user's behalf.

Figure 2A:
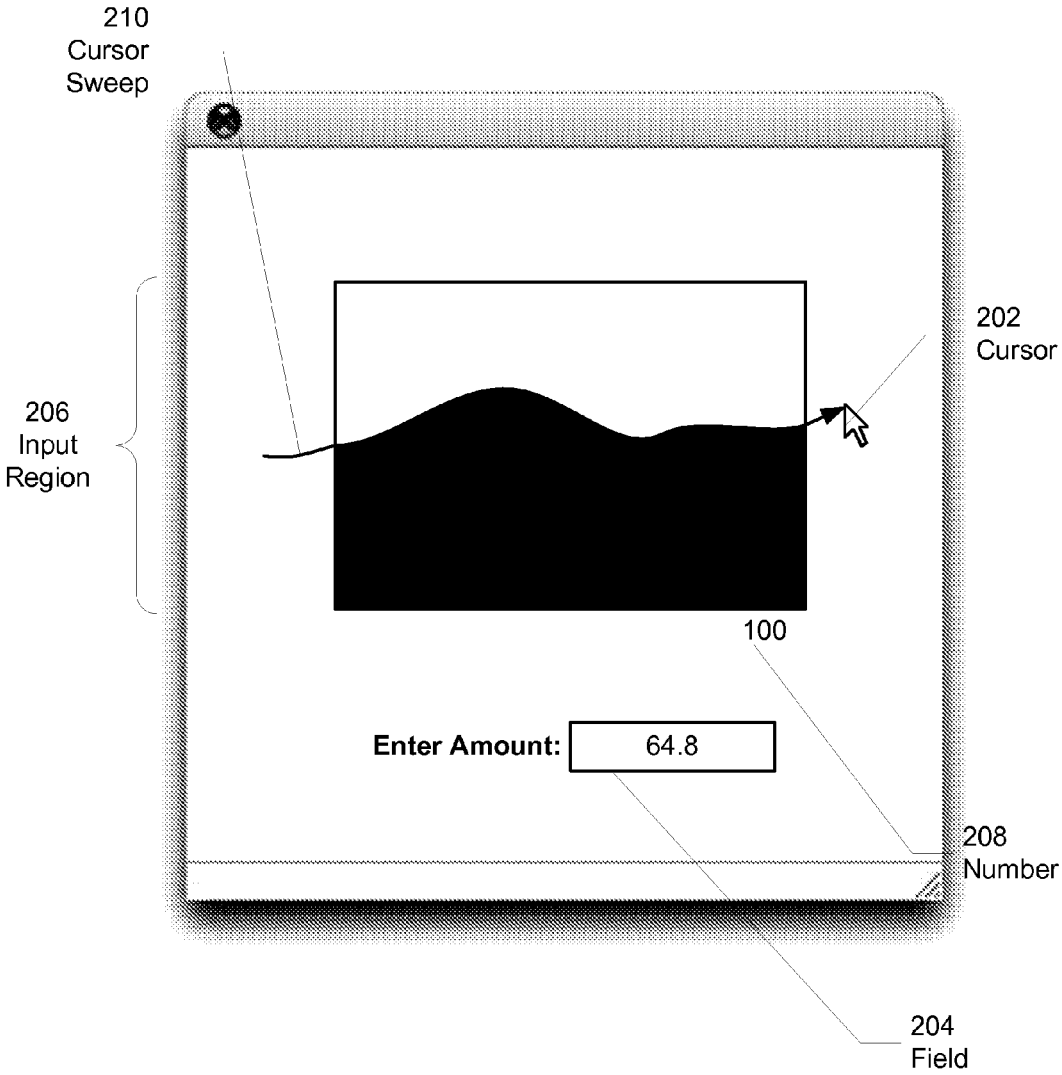
FIG. 2A shows an exemplary screenshot of a user interface in accordance with an embodiment of the present invention.

FIG. 2A shows an exemplary screenshot of a user interface in accordance with an embodiment of the present invention. More specifically, FIG. 2A shows a screenshot of an input region 206 in accordance with an embodiment of the present invention. In one or more embodiments of the invention, input region 206 provides an alternative numerical input method to the use of a keyboard and/or ten-key number pad. As shown in FIG. 2A, a cursor sweep 210 is made through input region 206 by a cursor 202. The shaded region below cursor sweep 210 corresponds to a subregion of input region 206, such as subregion 126 of FIG. 1.

As mentioned previously, the relative area of the subregion within input region 206 may be used to provide input to the user interface. In particular, the relative area of the subregion within input region 206 is used to provide numeric input to a field 204 within the user interface. As shown in FIG. 2A, the numeric input is calculated as a fraction of a number 208 associated with input region 206 from the relative areas of the subregion and input region 206. The numeric input is shown in field 204 as 64.8, indicating that 64.8% of input region 206 is filled using the subregion and that 64.8% of number 208 (i.e., 100) should be used as numeric input into field 204. The user may further refine the numeric input entered into field 204 by adding to and subtracting from the subregion, as discussed below with respect to FIGS. 2B-2D.

Figure 2B:
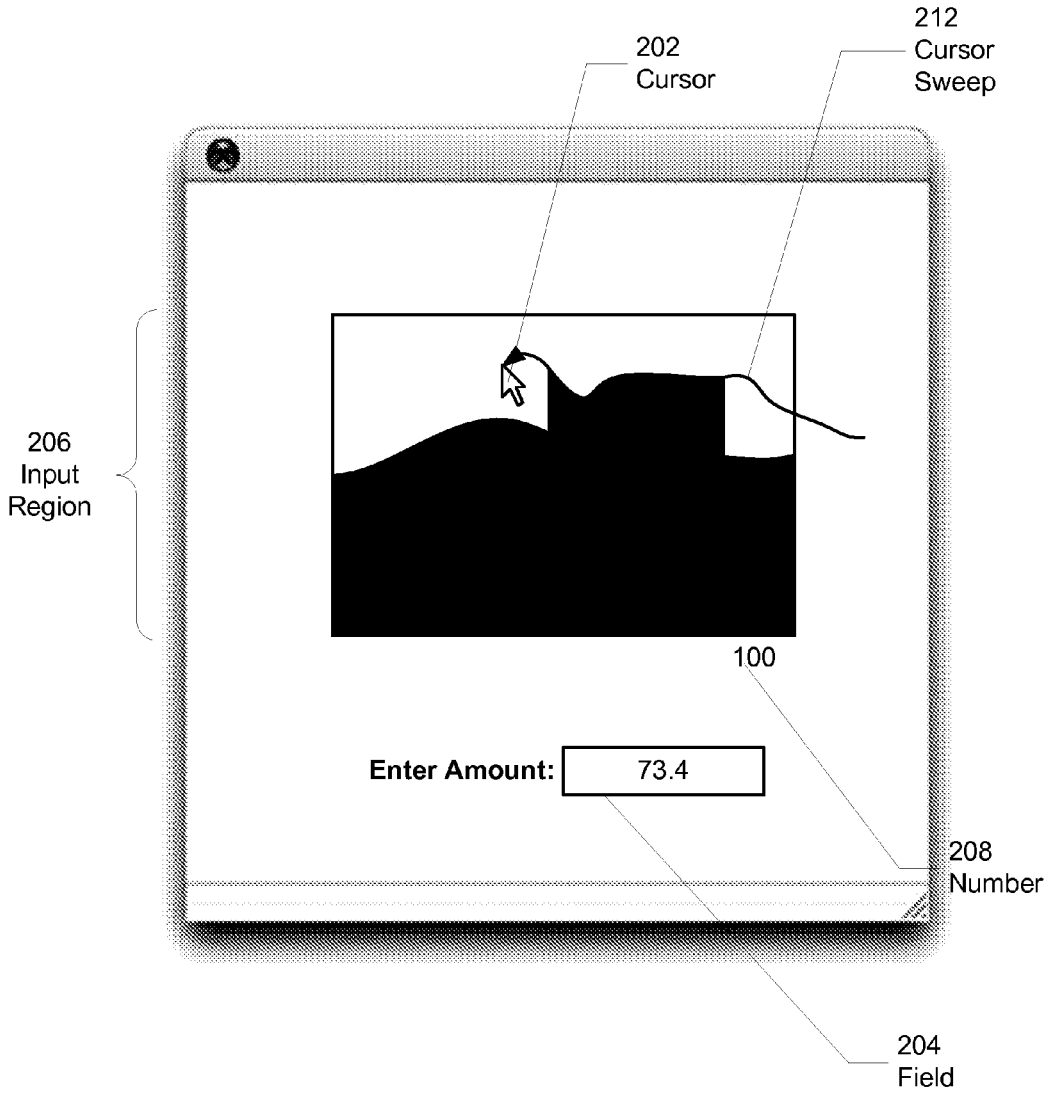
FIG. 2B shows an exemplary screenshot of a user interface in accordance with an embodiment of the present invention.

FIG. 2B shows an exemplary screenshot of a user interface in accordance with an embodiment of the present invention. More specifically, FIG. 2B shows the user interface of FIG. 2A with an addition to the subregion. The addition may be made using an additional cursor sweep 212 within input region 206. Because cursor sweep 212 starts and remains outside of the subregion, cursor sweep 212 causes an addition to the subregion. Moreover, only a section of input region 206 below cursor sweep 212 is added to the subregion, indicating that an additional action from the user, such as a mouse click or a button press may be required to provide a valid cursor sweep 212 as input into input region 206.

As shown in FIG. 2B, the area below cursor sweep 212 and above the initially filled subregion is added to the subregion within input region 206. Furthermore, field 204 is updated to reflect the addition to the subregion. In particular, field 204 includes the numeric input of 73.4, indicating that 73.4% of input region 204 is now filled with the subregion and that 73.4% of number 208 should be used as numeric input to field 204.

Figure 2C:
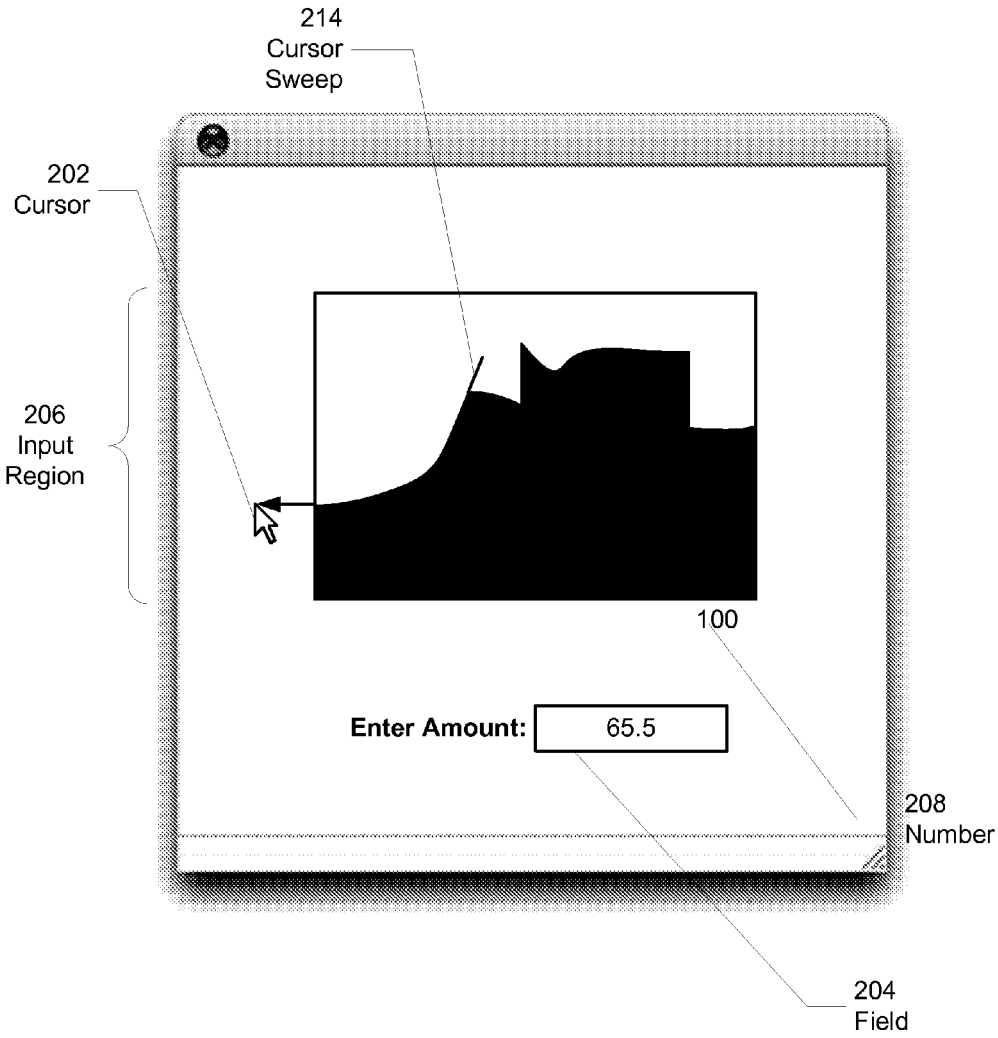
FIG. 2C shows an exemplary screenshot of a user interface in accordance with an embodiment of the present invention.

FIG. 2C shows an exemplary screenshot of a user interface in accordance with an embodiment of the present invention. More specifically FIG. 2C shows the user interface of FIG. 2B after a subtraction has been made to the subregion. Furthermore, a third cursor sweep 214 may be used to make the subtraction. Because cursor sweep 214 starts and ends outside the shaded region but carves an arc through the shaded region, the portion of the shaded region isolated by the arc is removed from the shaded region. On the other hand, if cursor sweep 214 ends before exiting the shaded region, the portion of the shaded region between the top border of the shaded region and cursor sweep 214 is subtracted from the shaded region.

Field 204 is also updated to reflect the change in the area of the subregion. In particular, field 204 contains numeric input of 65.5, suggesting that 65.5% of input region 206 now corresponds to the subregion and that 65.5% of number 208 should be used as numeric input to field 204. Alternatively, if input region 206 is associated with another number (e.g., 42), field 204 would instead be updated with 65.5% of that number (e.g., 27.51).

Figure 2D:
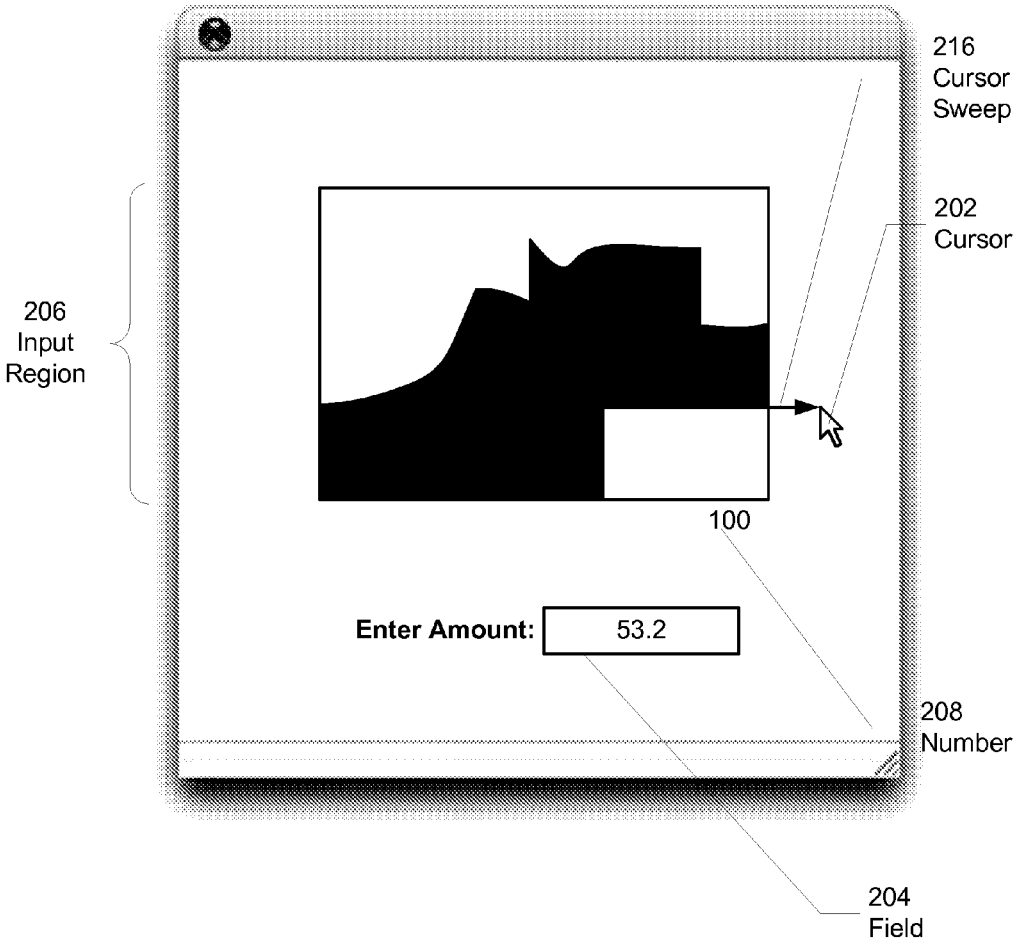
FIG. 2D shows an exemplary screenshot of a user interface in accordance with an embodiment of the present invention.

FIG. 2D shows an exemplary screenshot of a user interface in accordance with an embodiment of the present invention. In particular, FIG. 2D shows the user interface of FIG. 2C after another subtraction is made to the subregion. The subtraction is made using a fourth cursor sweep 216 that begins and remains within the subregion until exiting input region 206. The area below cursor sweep 216 is thus subtracted from the subregion.

Within FIG. 2D, field 204 is updated to reflect the subtraction from the subregion. The numeric input within field 204 of 53.2 indicates that 53.2% of input region 206 corresponds to the subregion and that 53.2% of number 208 is used as input to field 204. The user may further add to and subtract from the subregion within input region 206 until a desirable numeric input is provided to field 204.

Figure 3:
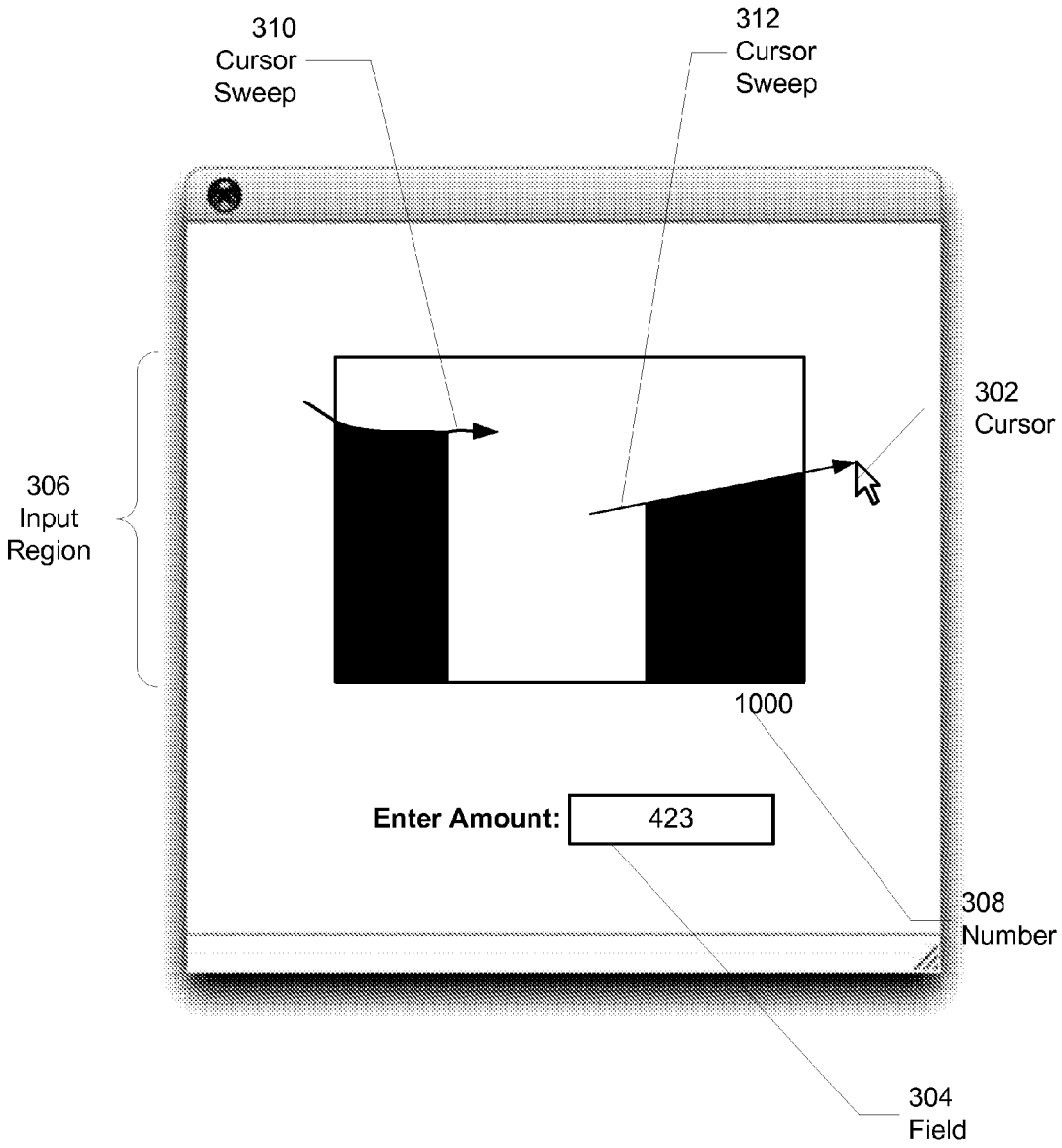
FIG. 3 shows an exemplary screenshot of a user interface in accordance with an embodiment of the present invention.

FIG. 3 shows an exemplary screenshot of a user interface in accordance with an embodiment of the present invention. More specifically, FIG. 3 shows a screenshot of an input region 306 in accordance with an embodiment of the present invention. As shown in FIG. 3, two cursor sweeps 310-312 are used to create a disjoint subregion within input region 306. The disjoint subregion may be created by filling in portions of input region 306 below valid sections of cursor sweeps 310-312. For example, the valid sections of cursor sweeps 310-312 may correspond to areas in which the user has clicked a mouse, pressed a button, applied a threshold amount of pressure to a stylus, entered input region 306, and/or performed another action using cursor 302 and/or other input devices.

A field 304 is also updated based on the relative areas of the subregion and input region 306. In particular, field 304 is updated as a percentage of a number 308 corresponding to the percentage of input region 306 that the subregion occupies. In other words, the numeric input of 423 to field 304 reflects the percentage (i.e., 42.3%) of input region 306 occupied by the subregion multiplied by number 308 (i.e., 1000), which is associated with input region 306 and may be considered the size of input region 306.

Figure 4A:
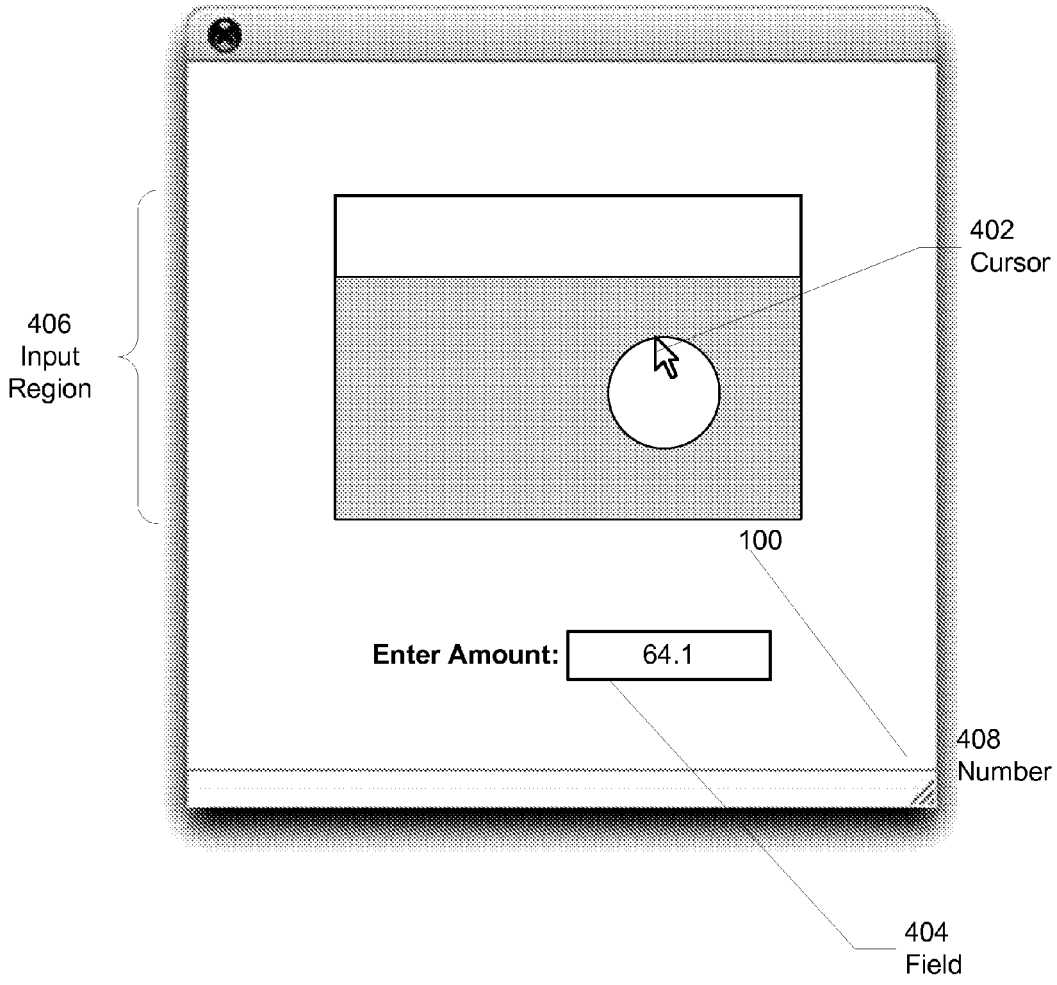
FIG. 4A shows an exemplary screenshot of a user interface in accordance with an embodiment of the present invention.

FIG. 4A shows an exemplary screenshot of a user interface in accordance with an embodiment of the present invention. Particularly, FIG. 4A shows an input region 406 that includes a shaded subregion. Furthermore, the subregion includes a circular area that is subtracted from the subregion. The subtraction is made entirely within the subregion by tracing a circular enclosed shape using cursor 402. Because the cursor sweep made by the cursor begins and ends at the same point within input region 406 and remains entirely within the subregion, the area enclosed using the cursor sweep is removed from the subregion. Alternatively, the subtraction may be made by dragging, locating, and sizing a shape or stencil using cursor 402.

A field 404 includes numeric input (i.e., 64.1) corresponding to the percentage of input region 406 filled in with the subregion (i.e., 64.1%) multiplied by a number 408 (i.e., 100) associated with input region 406. The number may be updated by further additions and subtractions to input region 406 by the user. Furthermore, the additions and subtractions may occur at a scaled input region to facilitate finer adjustments to the numeric input, as described below with respect to FIG. 4B.

Figure 4B:
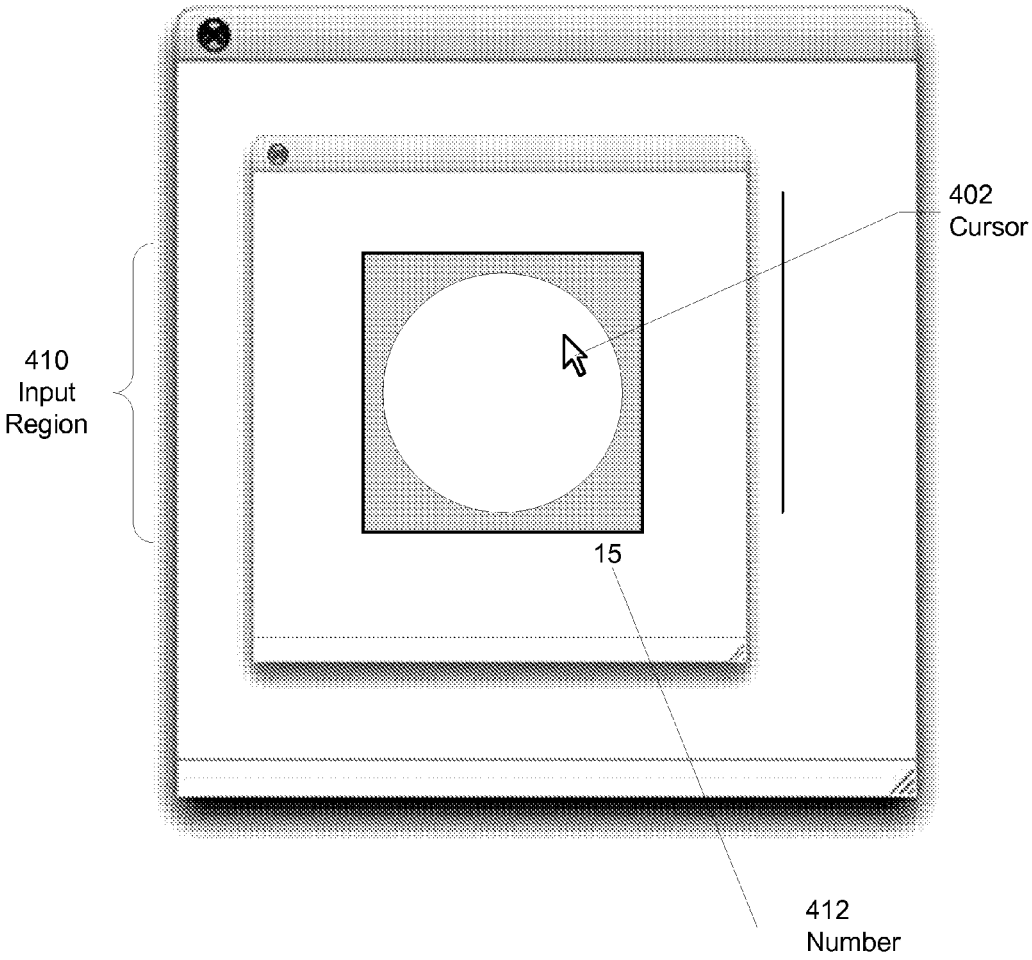
FIG. 4B shows an exemplary screenshot of a user interface in accordance with an embodiment of the present invention.

FIG. 4B shows an exemplary screenshot of a user interface in accordance with an embodiment of the present invention. More specifically, FIG. 4B shows the user interface of FIG. 4A with a scaled input region 410. The scaled input region may correspond to a zoomed-in section of input region 406 surrounding the circular subtraction to the subregion made by the user. As discussed above, input region 406 may be scaled if the user starts and ends a cursor sweep at the same point within input region 406. The area around the shape traced by the cursor sweep may thus be viewed at a larger size for finer adjustments to the subregion surrounding the shape.

As shown in FIG. 4B, a sub-window containing the scaled input region 410 is shown overlaid on the original window of FIG. 4A. A number 412 associated with input region 410 is also shown to guide additions and subtractions to the part of subregion within input region 410 by the user. In other words, the user may modify the numeric input to field 404 by adding or subtracting some or all of number 412, or 15. For example, the user may increase or reduce the size of the circular subtraction using one or more cursor 402 sweeps within input region 410. Once the user is finished making modifications to the subregion within input region 410, the user may return to input region 406 to make other modifications or submit the contents of field 404 as numeric input.

Figure 5A:
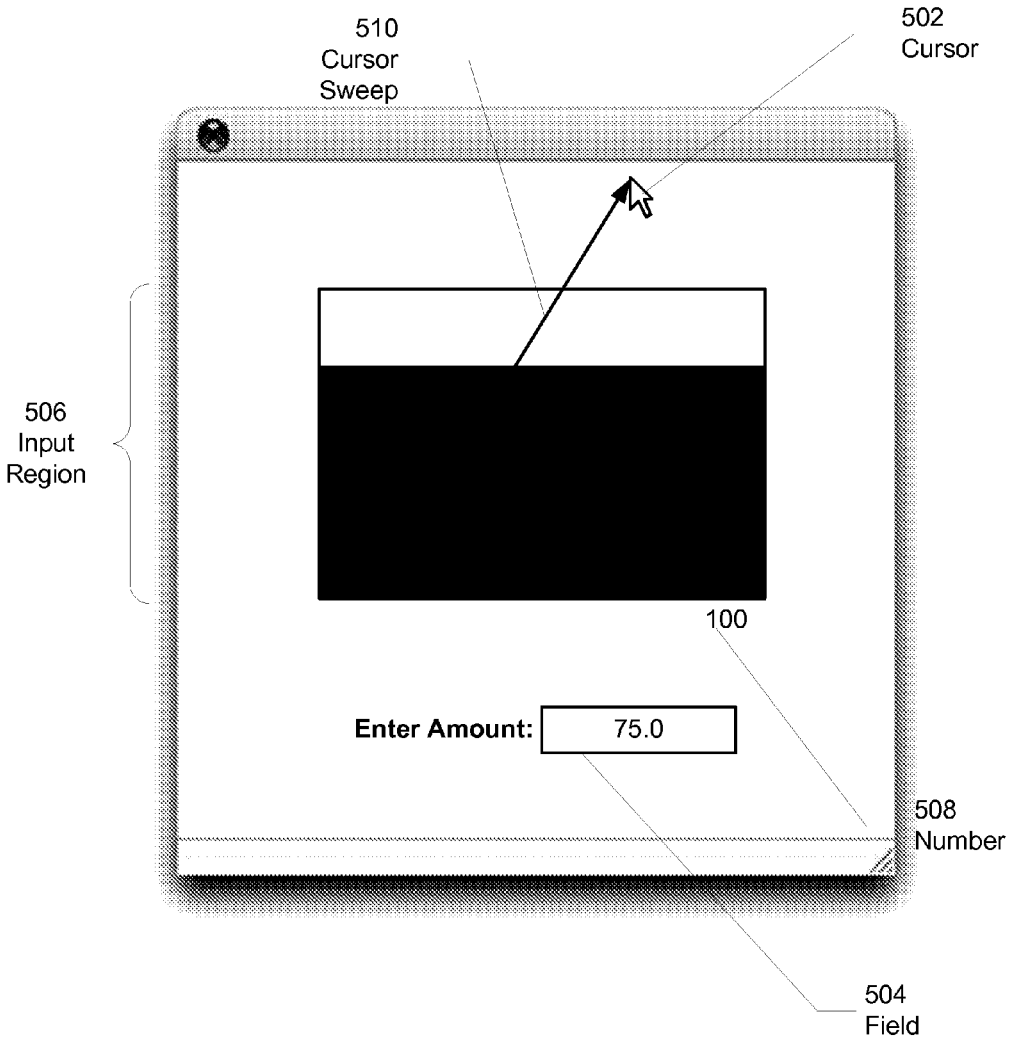
FIG. 5A shows an exemplary screenshot of a user interface in accordance with an embodiment of the present invention.

FIG. 5A shows an exemplary screenshot of a user interface in accordance with an embodiment of the present invention. As shown in FIG. 5A, the user interface includes an input region 506 that is mostly filled with a shaded subregion. A field 504 contains numeric input (i.e., 75.0) that reflects the fraction or percentage of input region 506 taken up by the subregion (i.e., 75%) multiplied by a number 508 (i.e., 100) associated with input region 506.

Furthermore, a cursor sweep 510 is made using a cursor 502. Cursor sweep 510 begins within the subregion in input region 506 and ends past the top of input region 506. As a result, cursor sweep 510 corresponds to an addition to the subregion between the line drawn using cursor sweep 510 and the top of the subregion. Because cursor sweep 510 extends past the top of input region 506, cursor sweep 510 may trigger a change in size of input region 506, as discussed below with respect to FIG. 5B.

Figure 5B:
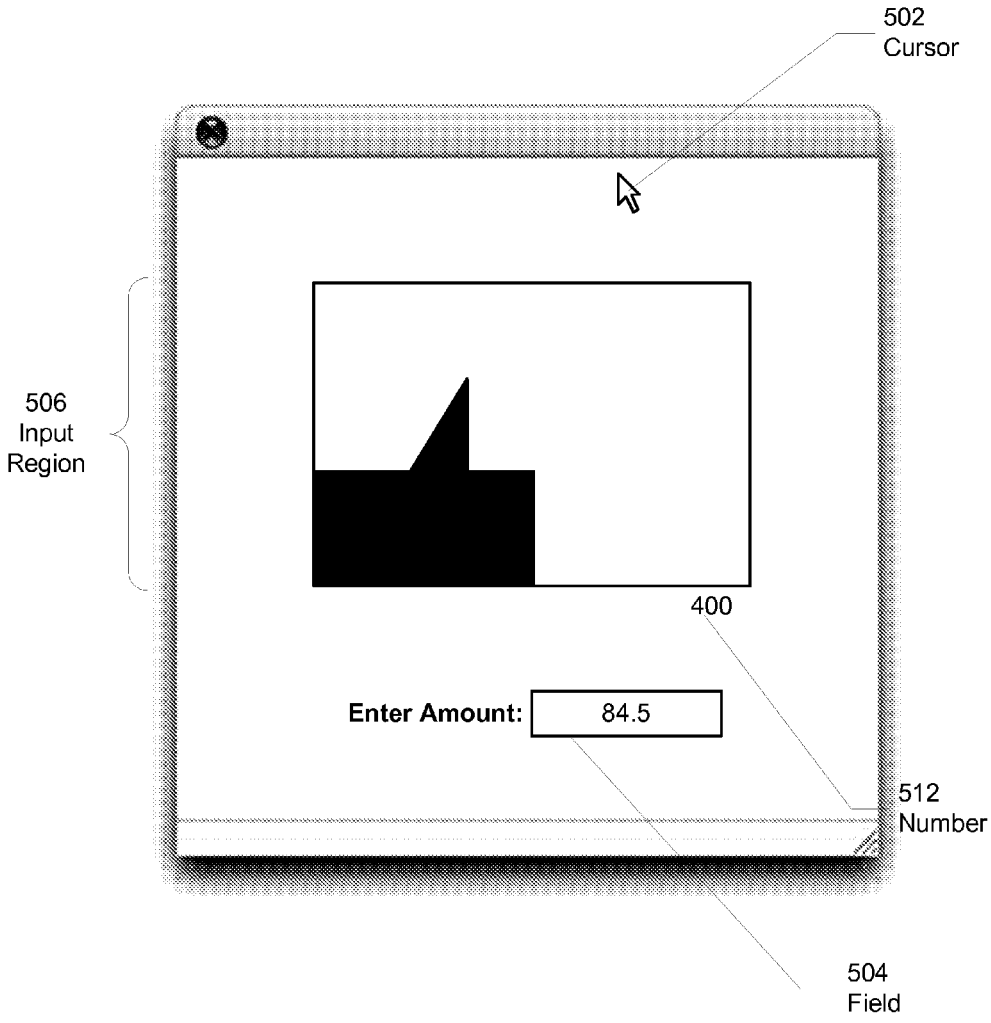
FIG. 5B shows an exemplary screenshot of a user interface in accordance with an embodiment of the present invention.

FIG. 5B shows an exemplary screenshot of a user interface in accordance with an embodiment of the present invention. More specifically, FIG. 5B shows the user interface of FIG. 5A with a resized input region 506. As described above with respect to FIG. 5A, cursor sweep 510 ends past the top of input region 506. As a result, input region 506 is increased in FIG. 5B in response to cursor sweep 510.

As shown in FIG. 5B, a new number 512 (i.e., 400) associated with input region 506 indicates that input region 506 has quadrupled in size. More specifically, input region 506 is associated with a different number 512 in FIG. 5B than in FIG. 5A. As a result, while input region 506 may be displayed at the same size within the user interfaces of FIGS. 5A and 5B, user actions within input region 506 may cause larger changes in the numeric input to field 504. For example, an addition of half of input region 506 may produce a change of 50 in field 504 in FIG. 5A, whereas the same addition may produce a change of 200 in field 504 in FIG. 5B. Because input region 506 has increased in size, the subregion within input region 506 is reduced to reflect the new relative sizes of the subregion and input region 506. Furthermore, the subregion is shown with the addition made using cursor sweep 510 in FIG. 5A.

Field 504 is also updated to reflect the addition to the subregion made by cursor sweep 510. In particular, field 504 contains numeric input of 84.5, indicating that approximately 21% of input region 506 is filled with the subregion and that the numeric input to field 504 is calculated as 21% of 400, the new size of input region 506. Because number 512 has increased with input region 506, the range of possible values in field 504 has also increased. In other words, the user may specify values between 0 and 400 using input region 506 rather than values between 0 and 100 in FIG. 5A.

Figure 6:
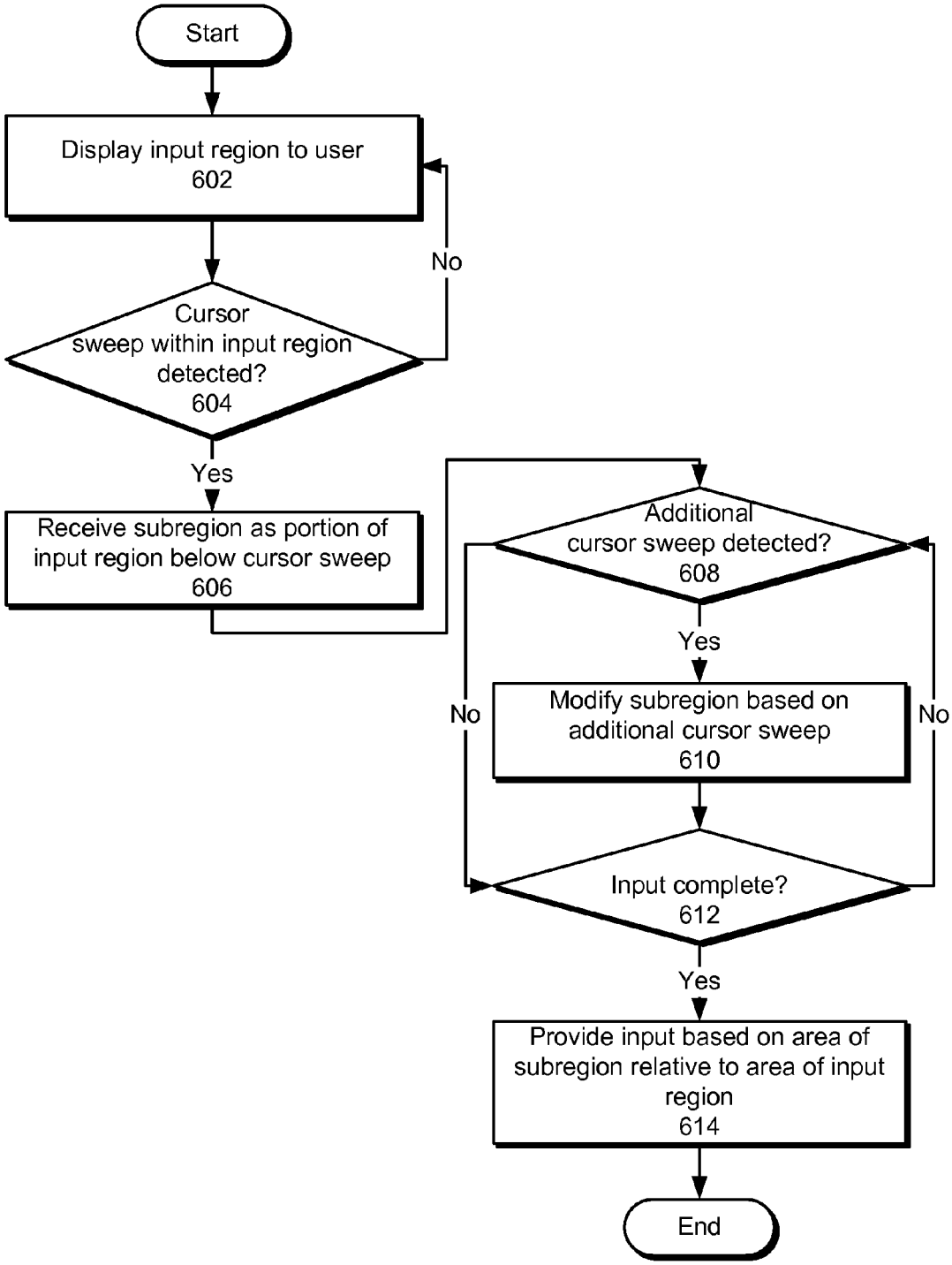
FIG. 6 shows a flow chart illustrating the process of receiving input from a user of a computing device in accordance with an embodiment of the present invention.

FIG. 6 shows a flow chart illustrating the process of receiving input from a user of a computing device in accordance with an embodiment of the present invention. In one or more embodiments of the invention, one or more of the steps may be omitted, repeated, and/or performed in a different order. Accordingly, the specific arrangement of steps shown in FIG. 6 should not be construed as limiting the scope of the invention.

First, an input region is displayed to the user (operation 602). The input region may be rectangular, circular, oval, polygon, and/or otherwise shaped. Furthermore, the area within the input region may be associated with a number that represents the size of the region. Input to the input region may thus be based on a relative area of a subregion within the input region.

To provide input to the input region, the user may perform a cursor sweep within the input region (operation 604). A valid cursor sweep may include a cursor movement within the input region, as well as other actions by the user, such as a mouse click or button press. If a valid cursor sweep is detected, a subregion of the input region is received as a portion of the input region below the cursor sweep (operation 606). Alternatively, if the cursor sweep traces an enclosed object, the subregion is received as the portion of the input region within the enclosed object. If a valid cursor sweep is not detected, the input region is continuously displayed to the user (operation 602) to allow the user to provide valid input to the input region.

The user may also modify the subregion by providing additional cursor sweeps (operation 608) to the input region. As with the initial cursor sweeps, additional valid cursor sweeps may involve cursor movements as well as other user actions. If an additional valid cursor sweep is detected, the subregion is modified based on the additional cursor sweep (operation 610). The modifications may include additions or subtractions to the subregion, changes in size of the input region, and changes in scale of the input region. The modifications may further be based on the paths of the additional cursor sweeps corresponding to the modifications, as discussed above.

The user may continue modifying the subregion until input is complete (operation 612) using the input region. Input may be complete when the user has finished modifying the subregion. If input is not complete, the user may continue to provide cursor sweeps (operation 608) and/or other actions that modify the subregion (operation 610). If input is complete, the input is provided based on the area of the subregion relative to the area of the input region (operation 614). In particular, numeric input may be calculated as a fraction of the area of the subregion within the area of the input region multiplied by the number associated with the input region. The numeric input may additionally be processed and/or mapped to non-numeric input, such as letters, words, countries, and/or other ordered lists.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A method for receiving input from a user of a computing device, comprising:

displaying an input region to the user;

receiving a specification for a subregion of the input region from the user by receiving a cursor sweep within the input region from the user, wherein the subregion is a portion of the input region below the cursor sweep;

determining an area of the subregion providing the input to the computing device based on the area of the subregion relative to the area of the input region;

receiving a first additional cursor sweep within the input region from the user, the first additional cursor sweep indicating one of an addition to or a subtraction from the subregion, an addition to the subregion comprising an addition of an area between a border of the subregion and a cursor sweep, and a subtraction from the subregion comprising a subtraction of an area between a border of the subregion and a cursor sweep;

receiving a second additional cursor sweep within the input region from the user, wherein, when the first additional cursor sweep indicated an addition to the subregion, the second additional cursor sweep indicates a subtraction from the same subregion, and, when the first additional cursor sweep indicated a subtraction from the subregion, the second additional cursor sweep indicates an addition to the same subregion; and after each of the first and second additional cursor sweeps, updating the area of the subregion based on the corresponding addition or subtraction.

2. The method of claim 1, further comprising receiving a third additional cursor sweep that indicates a change in scale of the input region.

3. The method of claim 1, wherein the addition or subtraction is made based on a path of the additional cursor sweep.

4. The method of claim 2, wherein the change in scale of the input region is caused by an ending point of the third additional cursor sweep past the top of the input region.

5. The method of claim 2, wherein the change in scale of the input region is caused by starting and ending the third additional cursor sweep at the same point in the input region.

6. The method of claim 1, wherein each cursor sweep is performed by the user manipulating a pointing device associated with the computing device.

7. The method of claim 6, wherein the pointing device comprises one of the following:

a mouse;

a touch pad;

a finger or a stylus on a touch-sensitive display;

a trackball;

a pointing stick; and a joystick.

8. The method of claim 1, wherein the input comprises numeric input, and wherein the numeric input is calculated from the area of the subregion relative to the area of the input region as a fraction of a number associated with the input region.

9. The method of claim 1, wherein the subregion is displayed as a filled-in portion of the input region.

10. A system for receiving input from a user of a computing device, comprising:

a user interface of the computing device, comprising:

an input region; and a cursor; and a user interface manager configured to:

receive a specification for a subregion of the input region from the user by receiving a cursor sweep within the input region from the user, wherein the subregion is a portion of the input region below the cursor sweep;

determine an area of the subregion;

provide the input to the computing device based on the area of the subregion relative to the area of the input region;

receive a first additional cursor sweep within the input region from the user, the first additional cursor sweep indicating one of an addition to or a subtraction from the subregion, an addition to the subregion comprising an addition of an area between a border of the subregion and a cursor sweep, and a subtraction from the subregion comprising a subtraction of an area between a border of the subregion and a cursor sweep;

receive a second additional cursor sweep within the input region from the user, wherein, when the first additional cursor sweep indicated an addition to the subregion, the second additional cursor sweep indicates a subtraction from the same subregion, and, when the first additional cursor sweep indicated a subtraction from the subregion, the second additional cursor sweep indicates an addition to the same subregion; and after each of the first and second additional cursor sweeps, update the area of the subregion based on the corresponding addition or subtraction.

11. The system of claim 10, further comprising receiving a third additional cursor sweep that indicates a change in scale of the input region.

12. The system of claim 10, wherein the addition or subtraction is made based on a path of the additional cursor sweep.

13. The system of claim 11, wherein the change in scale of the input region is caused by an ending point of the third additional cursor sweep past the top of the input region.

14. The system of claim 11, wherein the change in scale of the input region is caused by starting and ending the third additional cursor sweep at the same point in the input region.

15. The system of claim 10, further comprising:

a pointing device, wherein the cursor sweep is performed by the user manipulating the pointing device.

16. The system of claim 15, wherein the pointing device comprises one of the following:

a mouse;

a touch pad;

a finger or a stylus on a touch-sensitive display;

a trackball;

a pointing stick; and a joystick.

17. The system of claim 10, wherein the input comprises numeric input, and wherein the numeric input is calculated from the area of the subregion relative to the area of the input region as a fraction of a number associated with the input region.

18. The system of claim 10, wherein the subregion is displayed as a filled-in portion of the input region.

19. A non-transitory computer-readable storage medium storing instructions that when executed by a computer cause the computer to perform a method for receiving input from a user of a computing device, the method comprising:

displaying an input region to the user;

receiving a specification for a subregion of the input region from the user by receiving a cursor sweep within the input region from the user, wherein the subregion is a portion of the input region below the cursor sweep;

determining an area of the subregion;

providing the input to the computing device based on the area of the subregion relative to the area of the input region;

receiving a first additional cursor sweep within the input region from the user, the first additional cursor sweep indicating one of an addition to or a subtraction from the subregion, an addition to the subregion comprising an addition of an area between a border of the subregion and a cursor sweep, and a subtraction from the subregion comprising a subtraction of an area between a border of the subregion and a cursor sweep;

receiving a second additional cursor sweep within the input region from the user, wherein, when the first additional cursor sweep indicated an addition to the subregion, the second additional cursor sweep indicates a subtraction from the same subregion, and, when the first additional cursor sweep indicated a subtraction from the subregion, the second additional cursor sweep indicates an addition to the same subregion; and after each of the first and second additional cursor sweeps, updating the area of the subregion based on the corresponding addition or subtraction.

20. The computer-readable storage medium of claim 19, further comprising receiving a third additional cursor sweep that indicates a change in scale of the input region.

21. The computer-readable storage medium of claim 19, wherein the addition or subtraction is made based on a path of the additional cursor sweep.

22. The computer-readable storage medium of claim 20, wherein the change in scale of the input region is caused by an ending point of the third additional cursor sweep past the top of the input region.

23. The computer-readable storage medium of claim 20, wherein the change in scale of the input region is caused by starting and ending the third additional cursor sweep at the same point in the input region.

24. The computer-readable storage medium of claim 19, wherein each cursor sweep is performed by the user manipulating a pointing device associated with the computing device.

25. The computer-readable storage medium of claim 24, wherein the pointing device comprises one of the following:

a mouse;

a touch pad;

a finger or a stylus on a touch-sensitive display;

a trackball;

a pointing stick; and a joystick.

26. The computer-readable storage medium of claim 19, wherein the input comprises numeric input, and wherein the numeric input is calculated from the area of the subregion relative to the area of the input region as a fraction of a number associated with the input region.

27. The computer-readable storage medium of claim 19, wherein the subregion is displayed as a filled-in portion of the input region.

* * * * *